US006199308B1

(12) United States Patent
Westendorp

(10) Patent No.: US 6,199,308 B1
(45) Date of Patent: Mar. 13, 2001

(54) SYSTEM OF HINGES FOR POP-UPS

(76) Inventor: Gerard Westendorp, T.M.C. Asserplantsoen 12, Zetten 6671 BL (NL)

( * ) Notice: Subject to any disclaimer, the term of this patent is extended or adjusted under 35 U.S.C. 154(b) by 0 days.

(21) Appl. No.: 08/961,006

(22) Filed: Oct. 30, 1997

(30) Foreign Application Priority Data

Oct. 31, 1996 (NL) ..... 1004396

(51) Int. Cl.[7] ..... G09F 1/08
(52) U.S. Cl. ..... 40/124.08; 40/539
(58) Field of Search ..... 40/124.08, 539; 446/148, 488, 487

(56) References Cited

U.S. PATENT DOCUMENTS 3,995,388 * 12/1976 Penick et al. ..... 40/124.08
4,337,589 * 7/1982 Volkert et al. ..... 40/124.08

* cited by examiner

*Primary Examiner*—Cassandra H. Davis

(57) ABSTRACT

A system of hinges for pop-ups. The system consists of subsystems that could function on their own if they were ideally rigid, but which are in the practical situation in sufficiently rigid. The subsystems are interconnected by extra hinged connecting parts in such a way that the total system achieves as yet sufficient rigidity, but without impairing the sought pop-up movement.

3 Claims, 2 Drawing Sheets

SYSTEM OF HINGES FOR POP-UPS

CROSS REFERENCE TO RELATED APPLICATION

The invention is a translation of my earlier Dutch patent application, nr. 1004396, filed on Oct. 31, 1996. Priority benefits are claimed through this foreign application.

FIELD OF THE INVENTION

The invention concerns a system of hinges to be used in so-called pop-ups. Pop-ups are cards or books which are provided with moving parts, as to allow for a three-dimensional or motional effect.

BACKGROUND OF THE INVENTION

Two opposite pages of a book or card, together with the connecting hinge in between, form a system with one internal degree of freedom. This internal degree of freedom corresponds to the opening of the page, and will be referred to as the 'opening pages', noting that this can apply to books as well as cards or related promotional articles.

A Pop-up is characterised by the fact that apart from the opening pages there are also devices present that enable a three-dimensional or motional effect to be made. This effect can add artistic or educational value to the product. The most common device to this effect is the system of hinges.

A commonly applied principle in pop-ups is based on connecting panels of sheet material to the opening pages with the aid of hinges, in such a way that the total system, including the opening pages, has one internal degree of freedom. Thus, the action of opening the pages is coupled to the action of other panels in the system. The joint actions of the said panels compose the desired pop-up effect. In some cases, there are more than one degrees of freedom. In such a case, extra effects are actuated by suitable means other than the opening of the pages.

Many embodiments of the above principle are possible. Because of the large number of possible positionings of panels and hinges and possible combinations with other panels and hinges in the system, a large number of three dimensional or motional effects are possible. On the other hand, limitations are imposed by the available space and the lack of rigidity of the sheet material. The pop-up designer faces the challenge to create surprising effects in spite of these limitations.

Especially spectacular pop-up effects are achieved if the relative distances travelled by parts of the system are large. Indeed, in this case the difference with non-pop-ups is the most clear. The distance travelled by a point on a plane rotating about a hinge, is determined by the angle of rotation and the distance from the point to the hinge. In the case of the simplest pop-up system, a panel is connected to the opening pages, and the opening pages cover the panel when they are in the closed state. In this case, the maximum distance to a hinge that a point on the panel can have is determined by the maximum distance that can be covered with the pages. Furthermore, the angle of rotation is usually limited to 180 degrees. The existence of a maximum distance of a point on a panel to the hinge, and a maximum rotation angle leads to a maximum amount of movement relative to the opening pages by any point, when said simple pop-up system is used.

A method for achieving larger movements the the above, consists of connecting a second panel of sheet material to the first panel by means of a hinge, and whereby the first panel is in turn connected to the opening pages. The second panel should be positioned in the closed state of the pop-up in such a way that it is covered by the opening pages. During the pop-up action, the movement of of the second panel is the sum of its movement relative to the hinge connecting it to the first panel, and the movement of the first panel. This movement can be made greater than that wich uses only one panel. This principle can be extended by applying more panels, whereby the motion of the last panel the sum is of its motion around the last hinge and the motion of the preceding panels.

To achieve double- or multiple hinging pop-ups in practice however, a number of problem need to be solved. Firstly, the number of motional degrees of freedom of the system should remain one, so that the coupling to the opening pages is sustained. Secondly, the rigidity of the sheet material, often paper or cardboard, limits the possibilities. Systems of hinges that could work if the panels were ideally rigid, often turn out to be insufficiently rigid in practice. This is especially the case with the multiple hinged systems designated for making large movements. A third problem is that the hinges must operate over a sufficiently large angle, as multiple hinged systems are often folded back over large angles in order to optimally use the available space when the pop-up is in its closed state.

SUMMARY OF THE INVENTION

A system of hinges for pop-ups. The system consists of subsystems that could function on their own if they were ideally rigid, but which are in the practical situation insufficiently ridgid. The subsystems are interconnected by extra hinged connecting parts in such a way that the total system achieves as yet sufficient rigidity, but without impairing the sought pop-up movement.

DETAILED DESCRIPTION OF THE INVENTION

Figure 1:
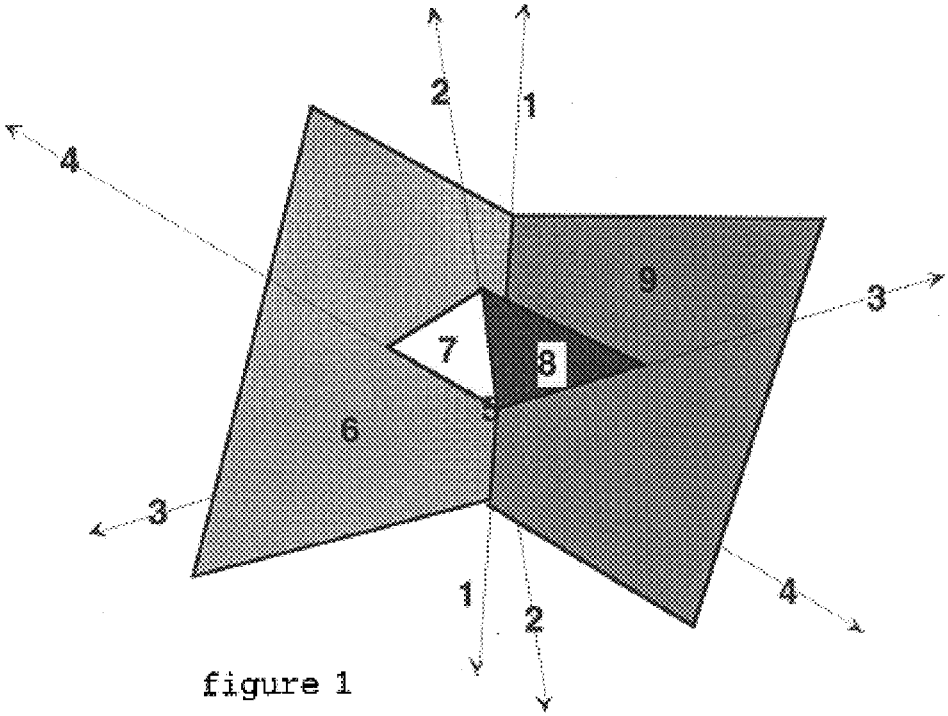
FIG. 1 shows what will be referred to as a 'pyramid system', a much used system in pop-ups.

The invention provides a system of hinges and panels that is able to solve the problems described above. FIG. 1 shows four hinges [1, 2, 3, 4] whose axes coincide in a single point [5], the hinges being connected by panels [6, 7, 8, 9]. Two adjacent panels [6, 9] coincide with the opening pages. The other panels [7, 8] form part of the pop-up. This construction, which will be referred to as a 'pyramid system', is used in many pop-ups. It has one internal degree of freedom, thus coupling the action of the opening pages to the action of the pop-up movement. By choosing suitable values for the four top angles of the pyramid, the system can be suited to the effect that is desired by the designer. The maximum angle over which the free hinge [2] can tilt over the top of the pyramid [5] during the pop-up action is 180 degrees for this construction, given a 180 degree movement of the opening pages. Angles approaching this maximum can only be reached implementing suitable angles between the hinges. Pyramid systems are not always obviously recognisable in pop-ups, because the shape of the panels need not be triangular, as only the positioning of the hinges is essential to the working principle.

Figure 2:
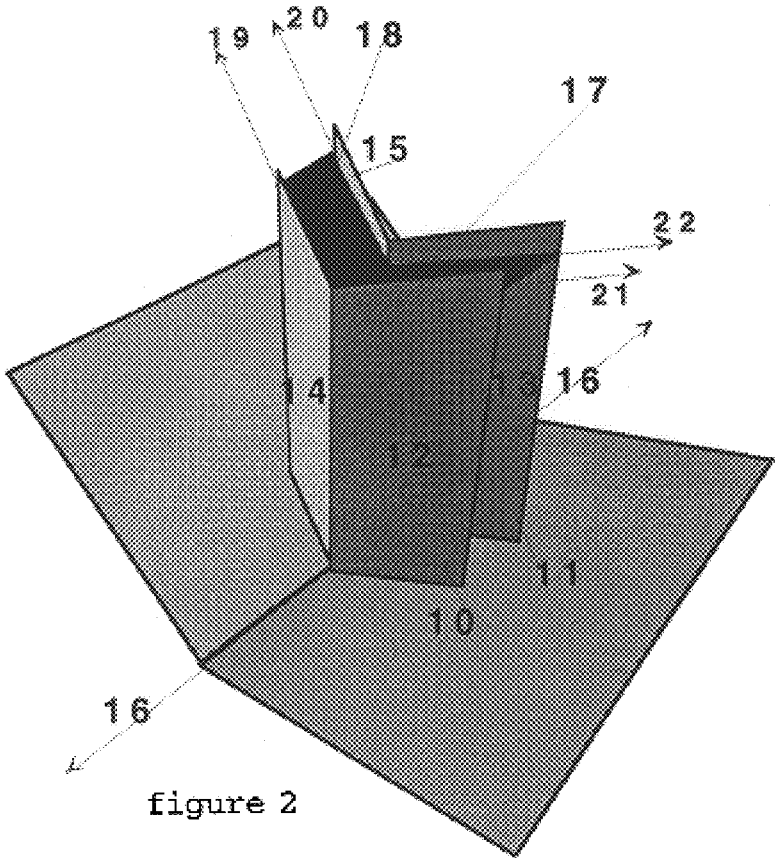
FIG. 2 shows two pyramid systems connected by hinged panels, providing a stiff construction.

FIG. 2 shows two congruent pyramid systems [10, 11], translated with respect to one another along the axis of the hinge of the opening pages. During the pop-up action, the faces [12, 14] and [13, 15] stay parallel, and the distance between the faces [14, 15] and the faces [12, 13] measured parallel to the hinge axis [16] of the opening pages stays contstant. This means that the internal degree of freedom of the pop-up is not impaired if connecting panels [17, 18] are applied, which are attached to the first panels by hinges [19, 20, 21, 22], said connecting panels are positioned parallel to the faces of the opening pages. This construction, which will be referred to as a 'double pyramid', is much more rigid than a single pyramid. This increased rigidity offers the possibility of using the double pyramid to actuate extra subsystems. Without the extra rigidity, the combined system could work if the panels were ideally rigid, but in practice, if the distances travelled are relatively big, the rigidity would be insufficient to convey the forces necessary to operate the extra subsystem. This is especially the case for pop-ups with large movements. For these pop-ups therefor, the construction in FIG. 2 is well suited.

Figure 3:
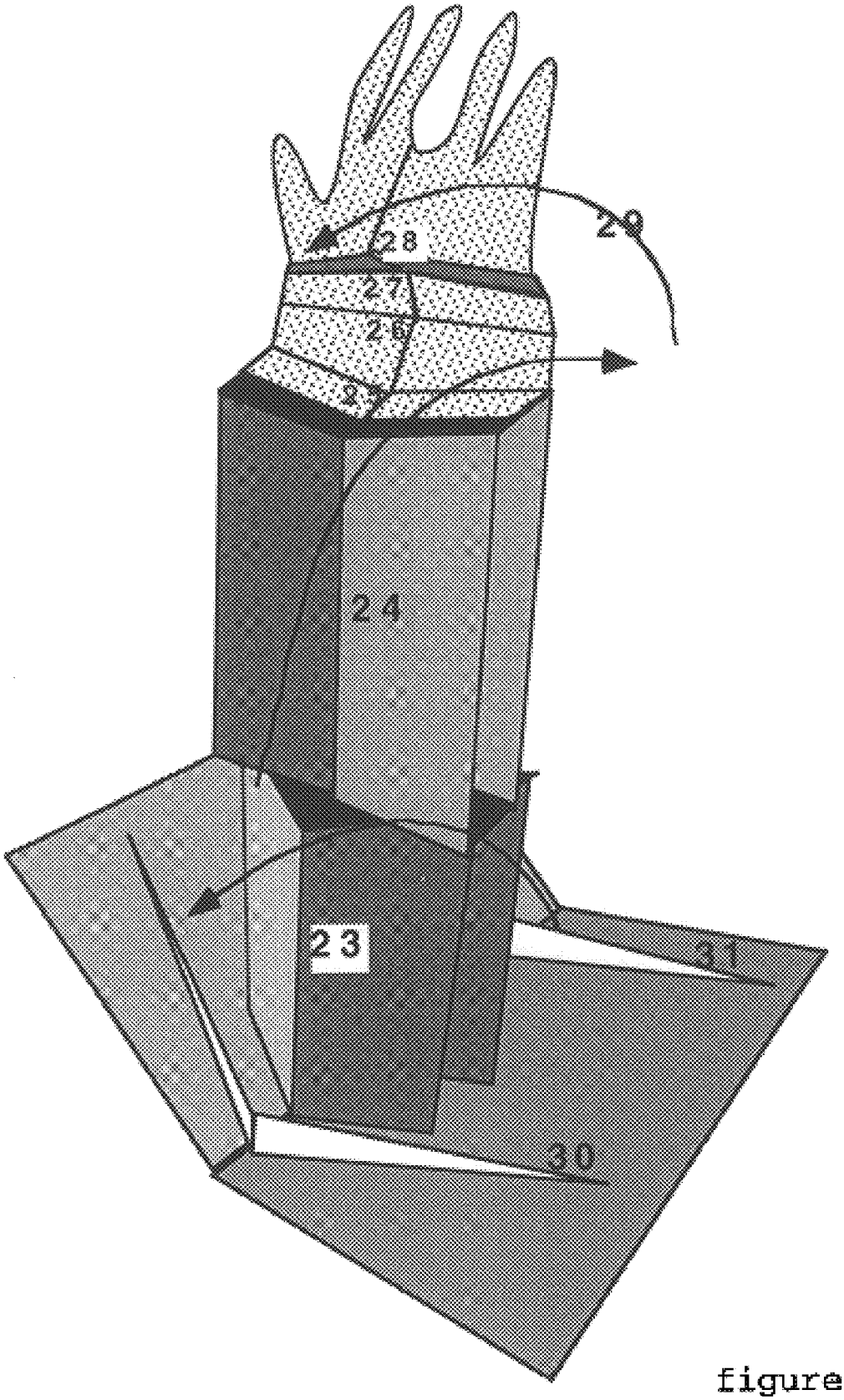
FIG. 3 shows how the construction in FIG. 2 can be used to create pop-ups which can make greater movements than possible with conventional pop-ups.

FIG. 3 shows an embodiment of the invention. A double pyramid [23] is used as a pedestal for a second double pyramid [24]. The movement of the second double pyramid is coupled to that of the first double pyramid. This construction allows for larger movement during the pop-up action than is possible with simpler constructions, for example those having only one pyramid system. The embodiment also has a construction consisting of a chain of four pyramid systems [25, 26, 27, 28]. These four pyramids together produce a tilting angle [29] of approximately 180 degrees. This means that parts that are furthest away from the hinge of the opening pages in the opened state of the pop-up, is not furthest away from the hinge of the opening pages in the closed state, so that the ratio of the size of the movement to the maximum distance covered by the opening pages in closed state is further increased. Furthermore, the embodiment comprises extra pyramid constructions [30, 31] that make the panels of the opening pages more rigid, so that the opening pages may be held at any point during the opening action. In the absence of these measures, the pages would be insufficiently rigid to convey the forces necessary to actuate the pop-up. The rigidity enhancing measures have the property that they fold flat in the closed state of the pop-up.

What is claim is:

1. System of hinges and panels, made of sheet material, applied in a pop-up, comprising:

(a) opening pages (b) a pedestal structure comprising:

(1) at least two subsystems of hinges and panels, connected to said opening pages (2) at least one additional panel (3) at least one additional hinge said additional panel interconnecting said subsystems with the aid of said additional hinge in such a way that said subsystems are not restrained in their movements by said additional panel and at the same time making said pedestal structure more rigid than said subsystems would be when operating separately, because said additional panel provides extra support to said pedestal structure (c) at least one additional pop-up part mounted on said pedestal structure said system of hinges and panels having the property that said system of hinges and panels can be folded flat upon closing the opening pages and that said system of hinges and panels can be erected upon opening the opening pages, and whereby said additional pop-up part mounted on said pedestal structure increases the capability of the pop-up for making large movements and whereby said pedestal structure is sufficiently rigid to support said additional pop-up part mounted on said pedestal structure.

2. System of hinges and panels as claimed in claim 1, having rigidity enhancing ridges attached to the opening pages, said ridges being constructed as to rise up when said system of hinges and panels is erected but to fold flat when said system of hinges and panels is folded flat, whereby giving the opening pages more bending resistance when said system of hinges and panels is being erected.

3. System of hinges and panels as claimed in claim 1. wherein at least two of said subsystems have mutually parallel hinges.

* * * * *